US006202268B1

(12) United States Patent
Goldstein et al.

(10) Patent No.: US 6,202,268 B1
(45) Date of Patent: Mar. 20, 2001

(54) POSITIVE LOCKING JEWELRY SAFETY LATCH

(76) Inventors: Avi Goldstein, 68 Muriel Ave., Lawrence, NY (US) 11559; Harout Ajaryan, 532 Riverdale Dr., Glendale, CA (US) 91204

( * ) Notice: Subject to any disclaimer, the term of this patent is extended or adjusted under 35 U.S.C. 154(b) by 0 days.

(21) Appl. No.: 09/203,966

(22) Filed: Dec. 2, 1998

(51) Int. Cl.[7] ..... A44B 19/00; A44B 11/26

(52) U.S. Cl. ..... 24/616; 24/589; 24/265 WS

(58) Field of Search ..... 24/589, 583, 68 J, 24/70 J, 69 J, 265 BC, 265 EC, 265 WS, 616, 615, 116 A, 163 K, 573.1, 573.5, 654, 652, 656; 63/3.1, 3; 403/319, 341, 386, 364

(56) References Cited

U.S. PATENT DOCUMENTS

| | | | | |
|---|---|---|---|---|
| 147,078 | * | 2/1874 | Stone | 24/616 X |
| 1,085,103 | * | 1/1914 | Bonner | 24/616 |
| 4,170,809 | * | 10/1979 | Geldwerth et al. | 24/616 |
| 4,426,854 | * | 1/1984 | Geldwerth et al. | 24/616 X |
| 4,520,537 | * | 6/1985 | Valikov | 24/116 A X |
| 4,543,692 | * | 10/1985 | Ode et al. | 24/616 |
| 4,675,955 | * | 6/1987 | Nakamura | 24/68 J X |
| 5,099,551 | * | 3/1992 | Hyun | 24/616 |
| 5,191,685 | * | 3/1993 | Aoki et al. | 24/265 WS X |
| 5,203,057 | * | 4/1993 | Runnels | 24/573.1 |
| 5,231,740 | * | 8/1993 | Mohebkhosravi | 24/616 |

* cited by examiner

*Primary Examiner*—Robert J. Sandy
(74) *Attorney, Agent, or Firm*—Greenberg Trauring LLP

(57) ABSTRACT

A positive locking safety latch for use as a secondary latch in ensuring the holding closed of an openable encircling jewelry item such as for the wrist (bracelets or watches), necklaces, anklets and the like, already locked closed by a primary latch. The secondary latch comprises an apertured member hingedly affixed to one end of the item to be latched closed and a post member with an enlarged head affixed to the other end of the item to be closed. The aperture of the apertured member is sized and positioned to be hingedly closely fitted over the enlarged head of the post when the primary latch is engaged. The apertured member further comprises a spring loaded chuck element which extends into the aperture and blocks entry of the enlarged head into the aperture. A retraction control causes retraction of the chuck element whereby the post can be fitted into the aperture. Release of the retraction control causes the chuck to redeploy with spring loaded engagement with the base of the post and with blocking resistance against the enlarged head of the post to prevent accidental disengagement and opening of the safety latch. Alternatively the latch can be used for primary latching with a positioning post which prevents lateral hinging of the latch.

3 Claims, 3 Drawing Sheets

POSITIVE LOCKING JEWELRY SAFETY LATCH

FIELD OF THE INVENTION

Figure 1:
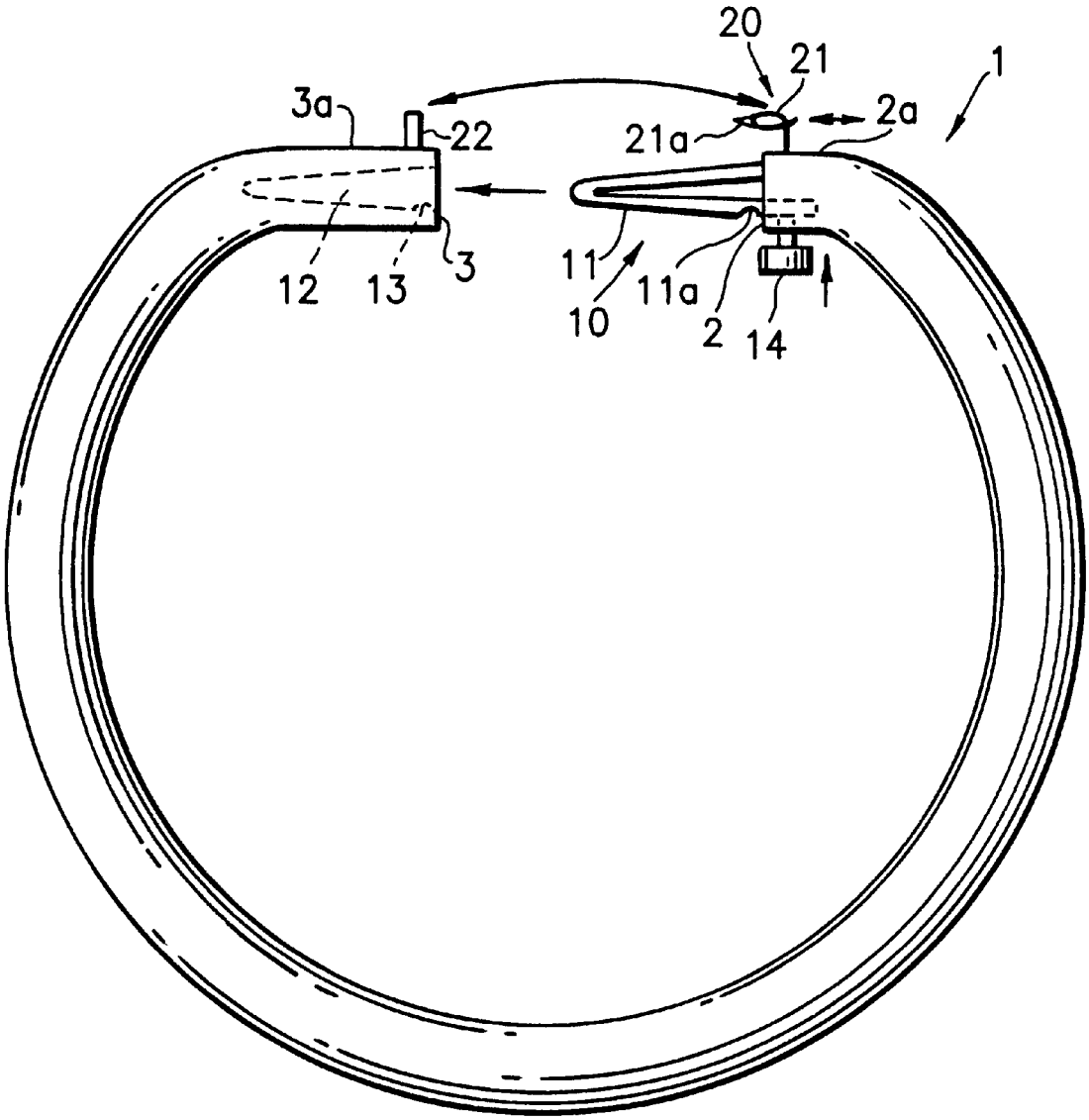
FIG. 1 PRIOR ART

This invention relates to latches for openable encircling jewelry items such as watches, bracelets, necklaces, anklets and the like and particularly to secondary safety latches for such jewelry items.

BACKGROUND OF THE INVENTION

Items of metal based jewelry (i.e., entirely or partially made of precious metal or with base metal closure elements) of the encircling type, e.g., most commonly watches and bracelets around the wrist, necklaces around the neck and anklets around the ankle, are often made in openable form for ease of placement on the limb or body part being adorned (bangles and continuous necklaces are large enough to be directly placed as unitary pieces and are accordingly not included in this discussion or the present invention).

In order to maintain the items of openable jewelry in place, metal items are provided with primary latching devices such as the common compressible "tongue in groove" wherein a compressible triangulated tongue on one end of the item to be closed is fitted into a corresponding receiving groove in the other end. The tongue is compressed until fully seated and springs open to engage a catch member or edge of the insertion aperture to prevent disengagement unless the tongue is again compressed by a release button or control. Other similar latching mechanisms abound and often the particular type of catch is determined by the aesthetics of the piece. Examples of other latching devices include spring-like beveled insertion members which are moved to an insertion position which resists opening. The control release in such embodiments operates movement of the bevel member to release the resistance.

One of the considerations for the primary latches is that they be substantially or completely hidden during use (except, necessarily for the release control) whereby they do not interfere with the aesthetics of the piece. This is especially important since the primary latches are normally large in size and span a substantial portion of the interface between the abutted ends.

Because of the value of jewelry and the fact that on a person's body it often may come into contact with other objects (clothing, walls, furniture, other people, etc.), with the release button or control being inadvertently activated, such jewelry (with some exceptions for aesthetic reasons) is usually also provided with a secondary safety catch. The secondary safety catch prevents the accidental loss of an expensive jewelry item should the primary catch fail or accidentally open. Often, however, since it is only secondary in nature, the mechanism of the secondary catch is very rudimentary and is prone to a high degree of failure. The most common secondary catch is a small hinged metal loop on one open end of the bracelet, watch and the like, with the other open end being provided with a post adapted to be frictionally engaged with the loop. The loop and post are usually positioned on a side or side edge of the bracelet, watch and the like whereby they are less conspicuous with respect to the aesthetics of the jewelry item. Release is effected by a hinged flipping back of the loop from engagement with the post.

A problem with the common secondary safety latches, which are operable by frictional engagement, is that over time and under pressure, the metal of the loop and/or the post tend to deform ever so slightly (and generally imperceptibly) but sufficiently such that the frictional engagement is tenuous at best and flipping off of the loop from the post can be effected by a simple touch or gravity. As a result, the safety function is compromised or lost, and very often without the wearer even being aware of such condition. However, providing a secondary safety latch of a substantive nature, akin to that of the primary latch (which is less subject to deterioration) is normally not physically or aesthetically feasible with unaesthetic bulk and unnecessarily complicated procedures in removal or placement of the jewelry item.

SUMMARY OF THE INVENTION

It is accordingly an object of the present invention to provide jewelry of an openable encircling type such as a watch, bracelet, necklace, anklet or similar item, with a positive locking secondary safety latch, which latch is aesthetically pleasing, provides little if any bulk more than normally associated with safety latches, and which latch is positive and not subject to loosening over time.

It is a further object of the present invention to provide a small, relatively unobtrusive latch mechanism which is adaptable to provide positive primary latch closure particularly where normally internally placed primary latching interferes with the structure of a small or delicate piece of jewelry.

Generally the present invention comprises a positive locking safety latch for use in ensuring the holding closed of an openable encircling jewelry item such as for the wrist (bracelets or watches), necklaces, anklets and the like, usually already locked closed by a primary latch. The positive locking latch comprises an apertured member hingedly affixed to one end of the item to be latched closed and a post member with an axially enlarged portion or head, which post is affixed to the other end of the item to be closed. The enlargement of the head need not be uniform or symmetrical or even at an end of the post but only sufficient to provide impedance means, as will be described. The aperture of the apertured member is sized and relatively positioned to be hingedly closely fitted over the enlarged head of the post when the primary latch is engaged or the ends of the jewelry item are abutted. The apertured member further comprises means which engage the impedance means of the post to provide positive resistance against removal of the post from the aperture. A preferred embodiment of such impedance and resistance means comprises a spring loaded chuck element which extends into the aperture and blocks normal entry of the enlarged head into the aperture. A retraction control permits retraction of the chuck element whereby the post can be fitted into the aperture. Release of the retraction control causes the chuck to redeploy with spring loaded engagement with the base of the post and with blocking resistance against the enlarged head of the post (the enlargement can therefore be a lateral bump or ring around an upper segment of the post to provide the requisite blocking resistance), to prevent accidental disengagement and opening of the safety latch. A simple depression of the retraction control, coupled with a normal release and open hinging of the apertured member as with prior art safety latches, effects release and opening of the safety latch. Since latch holding is dependent on a blocked movement rather than a frictional fit, there are no problems engendered by material deformation. Furthermore, the two step release procedure, while simple and readily effected, provides a positive insurance against inadvertent opening.

The simple chuck mechanism is fitted into an area normally occupied by an engaging loop, whereby added bulk is minimized and aesthetics can be maintained. Defects in the secondary latch are readily noticed if the safety latch becomes deployable without use of the retraction control.

These and other objects, features and advantages of the present invention will become more evident from the following discussion and drawings wherein (with some components shown in enlarged form for clarity):

SHORT DESCRIPTION OF THE DRAWINGS

Figure 2:
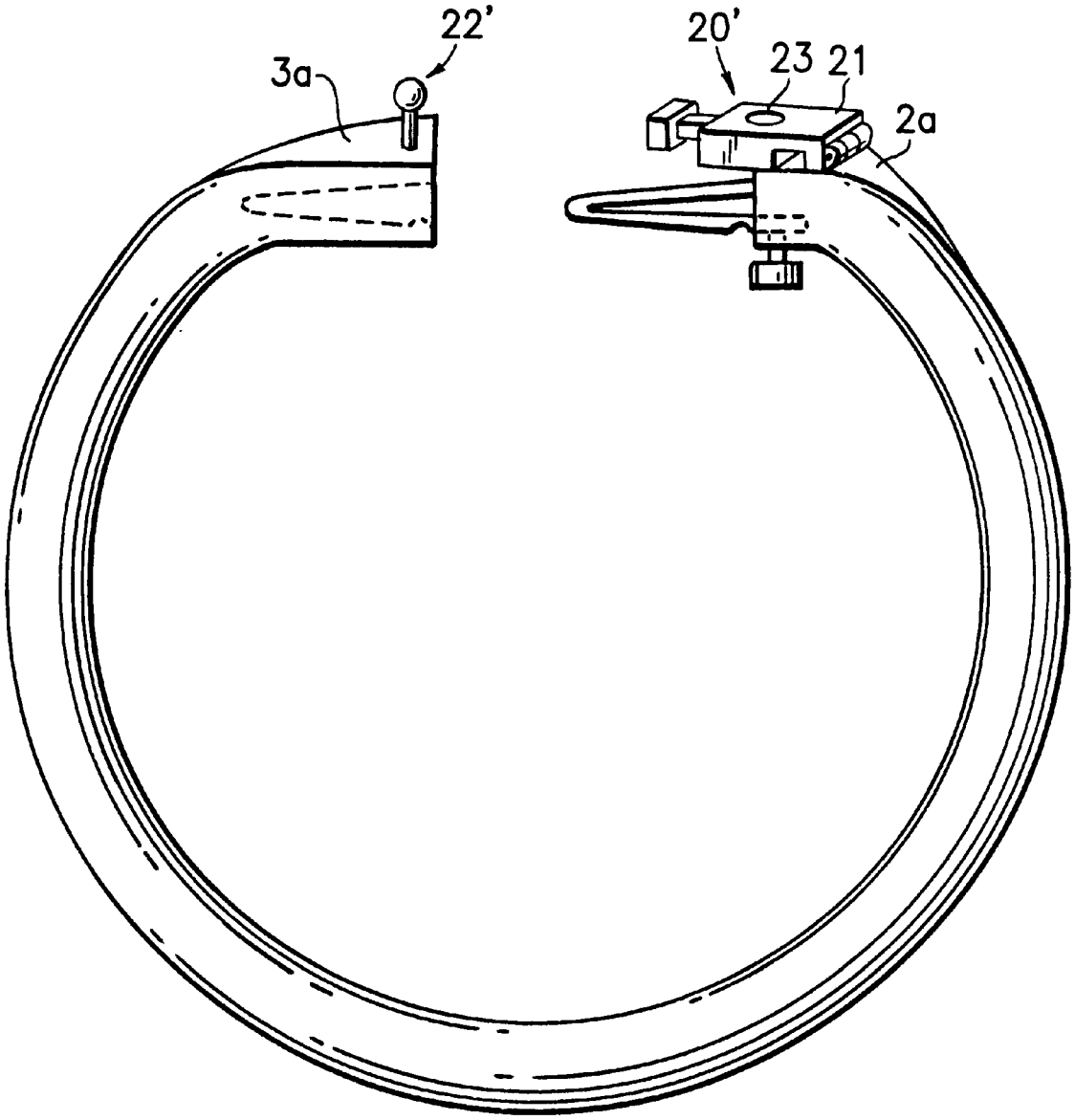
Figure 3:
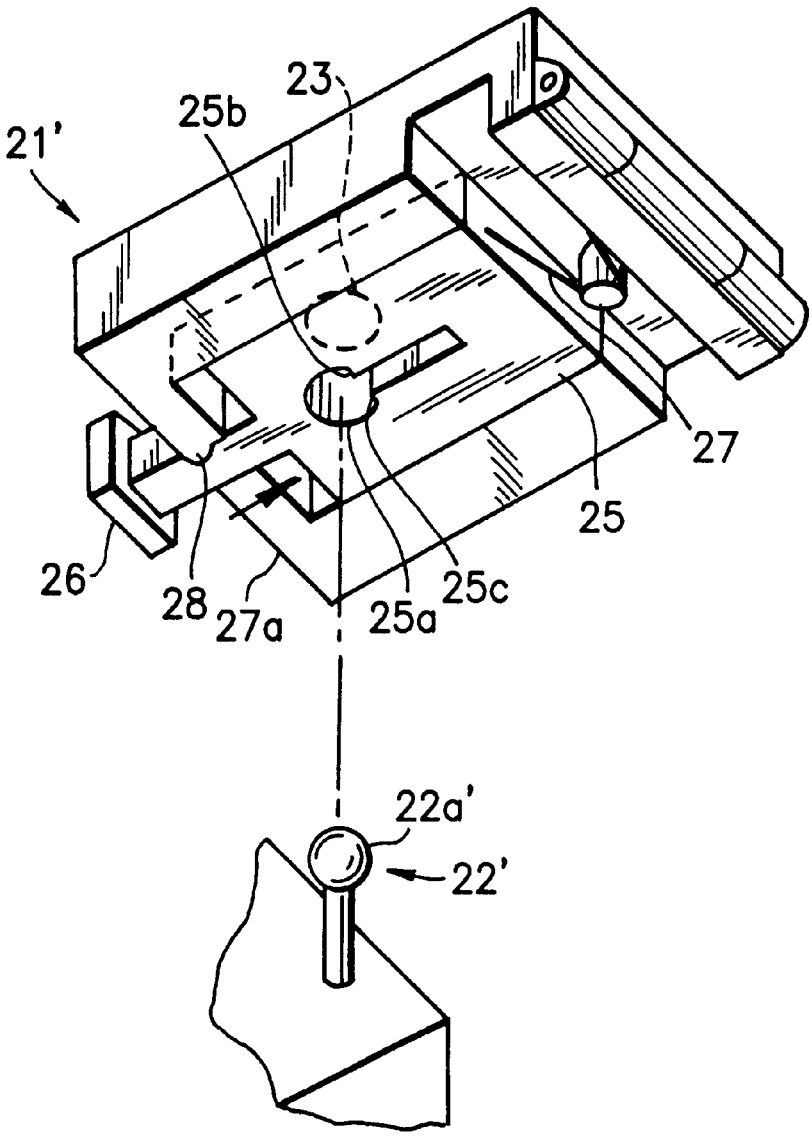

FIG. 1 is a side view of a bracelet of the prior art being fastened by a primary latching mechanism of the prior art and a typical secondary safety latch, with the arrows and dotted lines showing movement of the latching elements;

FIG. 2 is the bracelet of FIG. 1 modified to replace the safety latch of the prior art with the safety latch of the present invention; and FIG. 3 is an underside view of the safety latch of FIG. 2 showing the components of the secondary latch, with dotted line depiction of element placement in latching, showing the interaction of the latching member and post and the means for engagement and disengagement.

DETAILED DESCRIPTION OF THE INVENTION

In a preferred embodiment of the present invention, the secondary latch comprises a post with an enlarged head and a hinged rectangular element (which, for aesthetics, is dimensionally laterally confined within the width limits of the bracelet and the like) with a "post-hole" therein sized for insertion of both the post and enlarged head. The hinged element further comprises an end slot for the fixed insertion of a spring member (preferably a leaf spring) and an integral tongue with decorative push button control, for depression of the tongue against the spring. After the initial insertion the tongue is not removable and is movable for only a distance permitted by compression of the spring. The tongue is configured with a keyhole aperture with the upper (nearest the push button) portion of the aperture being sized to be co-extensive with the "post-hole" of the rectangular element. Alignment of the upper keyhole aperture and "post-hole" permits the post and enlarged head to pass therethrough. The base of the key hole is a narrow slot with the end thereof leading to the upper aperture being pushed into normal alignment with the "post-hole" to provide blockage therein to the insertion and removal of the enlarged head of the post. The spring keeps the "post-hole" and slot in normal alignment with each other and only full depression of the tongue serves to align the "post-hole" and upper end of the keyhole to permit insertion and removal of the post and opening of the secondary latch.

The secondary latch is normally positioned off to one side of juxtaposed ends. Accordingly, if the latch is designed for use as a primary latch it should be accompanied by a stabilizing member such as a post extending from one end and inserted into a socket of the other (similar to the tongue in groove but without a locking catch or control) in a socket to prevent unrestricted hinging about the peripherally positioned hinged latch.

DETAILED DESCRIPTION OF THE DRAWINGS AND THE PREFERRED EMBODIMENT

With reference to the drawings, in FIG. 1, a typical bracelet 1 (generally representative of items of encircling jewelry) has ends 2 and 3 which are abutted with each other for formation of an encircling configuration required for the wearing thereof. In order to maintain the bracelet in the encircling configuration (and to keep it from falling off the wearer), the abutted ends are locked together by engagement of primary latch 10, which comprises triangular tongue 11 extending from bracelet end 2, and corresponding reception slot 12 in end 3. Triangular tongue 11, at its widest point, includes arced notch 11*a* which is adapted to engage aperture edge 13. Catch control 14 is depressed to compress tongue 11 and move notch 11*a* out of engagement with edge 13, when removal of the bracelet is desired.

Secondary latch 20 is deployed at the ends 2 and 3 of the bracelet but on the lateral sides 2*a* and 3*a* thereof. Enlarged loop 21 is hingedly attached to lateral side 2*a* and is adapted to engage post 22 which is affixed to and extends from lateral side 3*a*. A somewhat tight frictional engagement between loop 21 and post 22 holds them together whereby, if the primary latch fails or is accidentally opened, the secondary latch holds the ends together to prevent accidental loss of the bracelet (or similar item). Loop 21 is removed from post 22 by flipping it off the post, using extending lever section 21*a*.

As shown in FIGS. 2 and 3, secondary latch 20 of the prior art is replaced with secondary latch 20' of the present invention which comprises apertured hinged member 21' and reshaped engaging post 22'. Hinged member 21' is hingedly attached to lateral side 2*a* of the bracelet and post 22' laterally extends from side 3*a*. Hinged member 21' is configured, as shown, in an aesthetic small, hollow, rectangular configuration. Hinged member 21' comprises, as more clearly shown in FIG. 3, 20 apertures 23 and 25*a*. Aperture 23 is circular and is sized to permit passage therethrough of post 22' and the enlarged head thereof 22*a*'. Aperture 23 is disposed at the end of the hinged member 21', distal from the hinge, and is configured in the form of a slot for the insertion thereof of chuck insert 25 which is in turn configured as a member with a keyhole aperture 25*a* and an integral control button 26. Spring 27 is positioned within the hollow of the hinged member 21' and the chuck insert 25 is fixedly inserted thereafter. Notch 28 engages end wall 27*a* to prevent removal of the chuck insert 25 from the hinged member 21'.

With normal deployment, spring 27 pushes the keyhole aperture 25*a* into a position whereby segments 25*b* and 25*c* partially block aperture 23 from direct insertion of the post head 22*a*'. Depression of button 26 serves to align keyhole aperture 25*a* with aperture 23 to thereby permit insertion of the post head 22*a*'. After such insertion, with extension of post 22' through aperture 23, spring 27 causes segments 25*b* and 25*c* to engage the base of post 22' with a chuck-like engagement (shown in dotted line), with any movement towards disengagement of the post from aperture 23 being positively blocked by segments 25*b* and 25*c* against the enlarged head 22*a*'. Depression of the control button 26 releases the chuck segments 25*b* and 25*c* from engagement with the enlarged head 22*a*' and permits the post 22' to be removed from the aperture 23 for opening of the latch.

In an embodiment wherein the safety latch of the present invention is utilized as a primary latch and in its laterally disposed position, it is desirable to replace the tongue member 11 with a minimally sized alignment post and a corresponding snug aperture in place of slot 12. This arrangement serves to prevent lateral hinged movement of the latch around it connection.

It is understood that the above description and preferred embodiment are illustrative of the present invention and that changes in structure and operation of the elements of the primary and secondary latches and the like may be made without departing from the scope of the present invention as defined by the following claims.

What is claimed is:

1. An openably closed encircling item of jewelry having two juxtaposable free ends and a positive locking safety latch for use in ensuring a closing holding engagement between the free ends, said latch comprising an apertured member hingedly affixed to one of said free ends and a post member with an enlarged portion thereof being affixed to the other free end, wherein an aperture of the apertured member is sized and relatively positioned to be hingedly closely fitted over the enlarged portion of the post member when the two free ends are brought into juxtaposed proximity, wherein the apertured member further comprises movable blocking means which blocks normal entry of the enlarged portion into the aperture, wherein the blocking means comprises a spring loaded insert element positioned within the apertured member with said insert element comprising an aperture of a dimension and configuration at least equal in dimension and configuration to the aperture of the apertured member wherein a retraction control means of the latch is adapted to move the spring loaded insert element into a position to cause the aperture of the apertured member and the aperture of the insert element to become coincident whereby the post member and the enlarged portion thereof are removably insertable through said apertures and wherein retraction of the retraction control means causes the post member to be engaged with spring loading against a peripheral edge of the aperture of the insert element, thereby blocking the enlarged portion from removal from the apertures.

2. The openably closed encircling item of jewelry of claim 1, wherein the item of jewelry is any of a bracelet, wrist watch, necklace and anklet.

3. The openably closed encircling item of jewelry of claim 1 wherein said latch is a secondary safety latch adapted to be engaged when a primary latch of said item of jewelry is engaged wherein said secondary latch ensures closure between the free ends if the primary latch is opened.

* * * * *